US009890593B2

(12) United States Patent
Marshall et al.

(10) Patent No.: US 9,890,593 B2
(45) Date of Patent: Feb. 13, 2018

(54) STEERABLE EARTH BORING ASSEMBLY HAVING FLOW TUBE WITH STATIC SEAL

(71) Applicant: Bitswave Inc., Sugar Land, TX (US)

(72) Inventors: Ricki Don Marshall, Sugar Land, TX (US); Treston Greggory Davis, Sugar Land, TX (US)

(73) Assignee: BITSWAVE INC., Sugar Land, TX (US)

( * ) Notice: Subject to any disclaimer, the term of this patent is extended or adjusted under 35 U.S.C. 154(b) by 287 days.

(21) Appl. No.: 14/920,340

(22) Filed: Oct. 22, 2015

(65) Prior Publication Data

US 2017/0002610 A1 Jan. 5, 2017

Related U.S. Application Data

(60) Provisional application No. 62/188,071, filed on Jul. 2, 2015.

(51) Int. Cl.
*E21B 7/06* (2006.01)
*E21B 7/04* (2006.01)

(52) U.S. Cl.
CPC ..... *E21B 7/067* (2013.01); *E21B 7/04* (2013.01)

(58) Field of Classification Search
CPC ..... E21B 7/067; E21B 7/04
USPC ..... 175/74
See application file for complete search history.

(56) References Cited

U.S. PATENT DOCUMENTS 2,903,242 A 9/1959 Bodine
3,239,016 A 3/1966 Alexander
4,650,009 A 3/1987 McClure
4,991,668 A 2/1991 Rehm
5,429,188 A 7/1995 Cameron
6,158,529 A 12/2000 Dorel
6,230,824 B1 5/2001 Peterman
6,554,062 B1 4/2003 Dewey
6,659,201 B2 12/2003 Head
6,837,315 B2 * 1/2005 Pisoni ..... E21B 7/067 175/269
6,913,095 B2 7/2005 Krueger
7,013,994 B2 3/2006 Eddison
7,096,980 B2 8/2006 Trevas
7,125,020 B2 10/2006 LeClair, Jr.
(Continued)

FOREIGN PATENT DOCUMENTS

WO 2013180822 A2 12/2013

OTHER PUBLICATIONS

International Search Report and Written Opinion for related PCT application PCT/US2016/040721 dated Sep. 12, 2016.

*Primary Examiner* — Taras P Bemko
(74) *Attorney, Agent, or Firm* — Bracewell LLP; Keith R. Derrington

(57) ABSTRACT

A steerable earth boring assembly which includes an annular collar and a drive shaft with a drill bit, where the shaft pivots with respect to the collar. An upstream portion of the shaft inserts into an orientation sleeve which resides in the collar. An axial bore is obliquely formed through the sleeve, and in which the upstream portion inserts. Rotating the sleeve causes precession of the upstream portion, thereby pivoting the drill bit obliquely to the collar. Selective rotation of the sleeve orients the drill bit into a designated orientation for forming a deviated wellbore. Included in the assembly is a flow tube with an end in sealing contact with the drive shall.

19 Claims, 11 Drawing Sheets

(56) References Cited

U.S. PATENT DOCUMENTS

| | | | | |
|---|---|---|---|---|
| 7,234,543 | B2 | 6/2007 | Schaaf | |
| 7,428,938 | B2 | 9/2008 | Marshall | |
| 7,556,105 | B2 | 7/2009 | Krueger | |
| 7,631,707 | B2 | 12/2009 | Ma | |
| 7,802,637 | B2 | 9/2010 | Aronstam | |
| 7,810,585 | B2 | 10/2010 | Downton | |
| 8,185,312 | B2 | 5/2012 | Ekseth | |
| 8,360,172 | B2 | 1/2013 | Santelmann | |
| 8,561,730 | B2 | 10/2013 | Yao | |
| 8,701,795 | B2 | 4/2014 | Menger | |
| 8,800,687 | B2 | 8/2014 | Shepherd | |
| 8,851,203 | B2 | 10/2014 | Smith | |
| 8,869,916 | B2 | 10/2014 | Clausen | |
| 8,881,846 | B2 | 11/2014 | Sitka | |
| 8,905,159 | B2 | 12/2014 | Downton | |
| 8,919,458 | B2 | 12/2014 | Plop | |
| 2004/0256162 | A1 | 12/2004 | Helms et al. | |
| 2005/0098350 | A1* | 5/2005 | Eppink | E21B 4/006 175/26 |
| 2012/0312600 | A1 | 12/2012 | Abbasi | |
| 2013/0014992 | A1 | 1/2013 | Sharp | |
| 2013/0092396 | A1 | 4/2013 | Webber | |
| 2013/0168152 | A1 | 7/2013 | Panahi | |
| 2013/0199844 | A1 | 8/2013 | Bayliss | |
| 2013/0264120 | A1 | 10/2013 | Zhou | |
| 2013/0299246 | A1* | 11/2013 | Shepherd | A61F 13/15747 175/61 |
| 2013/0319764 | A1* | 12/2013 | Schaaf | E21B 7/06 175/24 |
| 2014/0037232 | A1 | 2/2014 | Marchand | |
| 2014/0048334 | A1 | 2/2014 | Pabon | |
| 2014/0131106 | A1 | 5/2014 | Coull | |
| 2014/0158427 | A1* | 6/2014 | Zaki | E21B 7/06 175/24 |
| 2014/0174831 | A1* | 6/2014 | Sitka | E21B 7/062 175/76 |
| 2014/0182941 | A1* | 7/2014 | Oppelaar | E21B 7/067 175/61 |
| 2014/0345949 | A1 | 11/2014 | Cramer | |

* cited by examiner

T
132
134
136
138
130
140
150
142
126
148
128
147
128
152
156
154
158
144
146
37
30
18

STEERABLE EARTH BORING ASSEMBLY HAVING FLOW TUBE WITH STATIC SEAL

CROSS REFERENCE TO RELATED APPLICATIONS

This application claims priority to and the benefit of U.S. Provisional Application Ser. No. 62/188,071, filed Jul. 2, 2015, the full disclosure of which is hereby incorporated by reference herein in its entirety for all purposes.

BACKGROUND OF THE INTENTION

1. Field of Invention

The present disclosure relates to a system tor controlling a path of a drill bit in a subterranean formation. More specifically, the present disclosure relates to a steerable drilling assembly having a static seal and a tapered bore.

2. Description of Prior Art

Earth boring drilling systems are typically used to form wellbores that intersect subterranean formations having hydrocarbons so that the hydrocarbons can be extracted from the formations. The drilling systems usually include a rotatable drill string having a drill bit on its lower end for excavating through the formation The drill string and drill bit are typically rotated by either a top drive or rotary table provided on surface. The types of drill bits are usually either roller cone bits or drag bits; and where cutting elements are generally formed on the bits. The combination of axial pressure on the drill string, combined with drill string rotation, causes the cutting elements to excavate through the formation and form cuttings that are circulated back uphole with drilling fluid.

Non-vertical or deviated wellbores are sometimes formed by whipstocks that are disposed in the wellbore and deflect the bit and drill string along a designated path in the formation. Deviated wellbores are often formed using mud motors mounted onto the drill string, which have fixed or adjustable angle bent sub housings and, when used in a sliding only mode are selectively oriented to direct the bit along a chosen direction. Deviated wellbores are otherwise formed using rotary steerable systems, which provide a means of steerable drilling while also permitting most or all of the drill siring to rotate during steering operations.

SUMMARY OF THE INVENTION

Disclosed herein is an example of a steerable earth boring assembly. One example of the earth boring assembly includes an annular collar that has an end in selective engagement with a drill string, an annular flow tube disposed in the collar that is in fluid communication with an annulus in the drill string, a drive shaft coupled with the collar and that is pivotable with respect to the flow tube, a bore axially formed through the drive shaft that selectively receives an earth boring bit and that is in fluid communication with the flow tube, and a sealing element that defines a static seal between the flow tube and drive shaft. Alternatively, the bore has a diameter that increases with distance away from the profile to define a shroud portion, and wherein the flow tube inserts into the shroud portion, so that when the drive shaft pivots an inner diameter of the bore within the shroud portion is spaced away from an outer surface of the How tube. The sealing element can continue to block a flow of fluid when the drive shaft pivots with respect to the collar. In an example, the sealing element is an elastomeric O-ring that circumscribes the flow tube. The steerable earth boring assembly can further include a splined coupling for transferring a rotational force between the collar and the drive shaft, so that when a rotating drill string applies a rotational force to the collar, the rotational force is transferred to the drive shaft and the drill bit through the splined coupling. The steerable earth boring assembly can further optionally include an orientation sleeve having a generally cylindrical outer surface and that is coaxially disposed in the collar, a bore in the orientation sleeve that extends along a path that is oblique to an axis of the orientation sleeve, and wherein an end of the drive shaft distal from the drill bit inserts into the bore in the orientation sleeve, so that when the orientation sleeve is rotated, the drill bit shaft and the drill bit swivel with respect to the collar. The flow tube can be rationally coupled with the drive shaft. In an example, the drive shaft processes about a plane in which the seating element is substantially disposed.

In another example of a steerable earth boring assembly, included are a drive shaft that selectively couples to a drill string and that is selectively changed into an orientation that is oblique to the drill string, an axial bore in the drive shaft with an end that selectively receives a drill bit, an annular How tube that is rotationally coupled with the drive shaft and which includes, an end in fluid communication with an annulus in the drill string, and a distal end in fluid communication with the bore in the drive shaft, so that when drilling fluid is provided into the annulus in the drill string, the drilling fluid flows to the drill bit via the bore and the flow tube. This example further includes a seal between an outer surface of the flow tube and an inner surface of the bore in the drive shaft. A diameter of the bore can increase at a location distal from the drill bit to define a shroud portion, and wherein a portion of the flow tube is circumscribed by the shroud portion. Optionally in this example, the drive shaft swivels with respect to the flow tube, and can swivel about a plane in which the seal is disposed. The seal can be rotationally coupled to the flow tube and to the drive shaft to define a static seal.

An additional example of a steerable earth boring assembly includes an annular flow tube in fluid communication with an annulus in a drill string, a drive shaft rotationally coupled with the flow tube and that is selectively swiveled with, respect to the flow tube, a bore axially formed through the drive shaft that selectively receives an earth boring bit and that is in fluid communication with the flow tube, and a sealing element that defines a static seal between the flow tube and drive shaft. The sealing element can be a resilient O-ring, Moreover, the sealing element can be rotationally coupled to both the flow tube and to the drive shaft. The drive shaft can swivel about a plane in which the sealing element is disposed. The steerable earth boring assembly can further include a collar for coupling the drive shaft to the drill string; and may optionally also include a means for swiveling the drive shaft, so that the drive shaft is moveable in a precession like motion.

BRIEF DESCRIPTION OF DRAWINGS

Some of the features and benefits of the present invention having been stated, others will become apparent as the description proceeds when taken in conjunction with the accompanying drawings, in which.

Figure 1C:
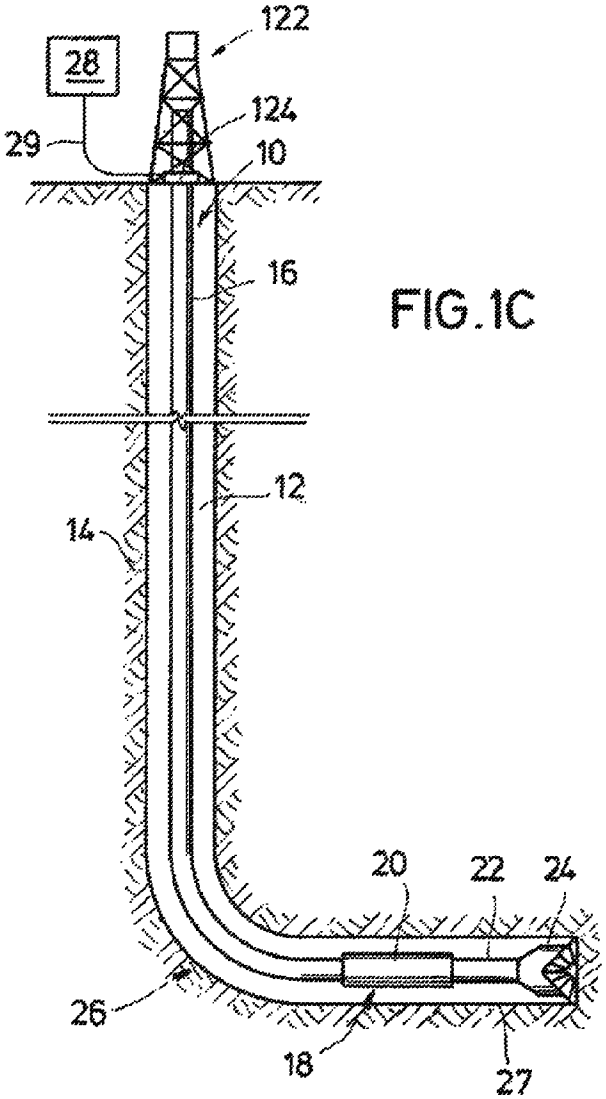
FIGS. 1A-1C are side partial sectional views of an example of a steerable earth boring assembly forming a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1B:
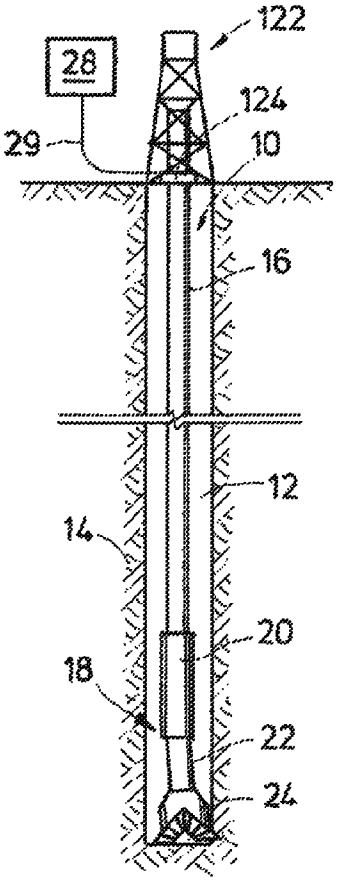
Figure 1A:
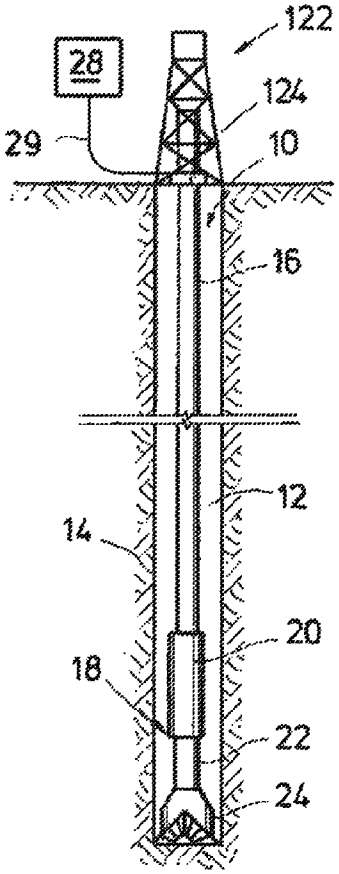

Shown in a side partial sectional view in FIGS. 1A through 1C is one example of a drilling assembly 10 forming a wellbore 12. Wellbore 12 intersects a formation 14 and wherein drilling assembly 10 includes a rotating drill string 16 for delivering rotational power to form the wellbore 12. A steering unit assembly ("SUA") 18 is shown mounted on the lower end of drill string and which provides the cutting action to excavate the wellbore 12. Included within SUA 18 is a steering sub 20 which has an articulated sub 22 projecting from its downstream end. A drill bit 24 mounts on a lowermost end of articulated sub 22. As illustrated in FIG. 1B, articulated sub 22 can be pivoted so that it is oriented at an angle that is oblique with steering sub 20. Referring now to FIG. 10, the selective pivoting of the articulated sub 22 redirects the path SUA 18 so that it forms a bend 26 in wellbore 12. Downhole of the bend 26, the SUA 18 can be guided along a generally horizontal path as shown to thereby form a deviated portion 27 of the wellbore 12. However, deviated portion 27 can also be at an angle that is generally oblique with the vertical section of wellbore 12 shown uphole of bend 26.

An optional controller 28 shown on surface, which can downlink to the SUA 18, and in an example provide control signals or commands from surface to SUA 18, which the SUA 18 is configured to decode and perform a function in response to the control signal or command. Downlinking can be performed mechanically to generate the signals downhole, such as by varying drill string rotation, varying mud flow rate, mud pulse telemetry, to name a few. In an alternative, a control line 29 is shown providing communication between controller 28 and SUA 18. Embodiments exist wherein control signals and feedback may be transferred via control line 29. Alternatively, information regarding downhole conditions or operational parameters of the SUA 18 can be transmitted to the controller 28.

Figure 2:
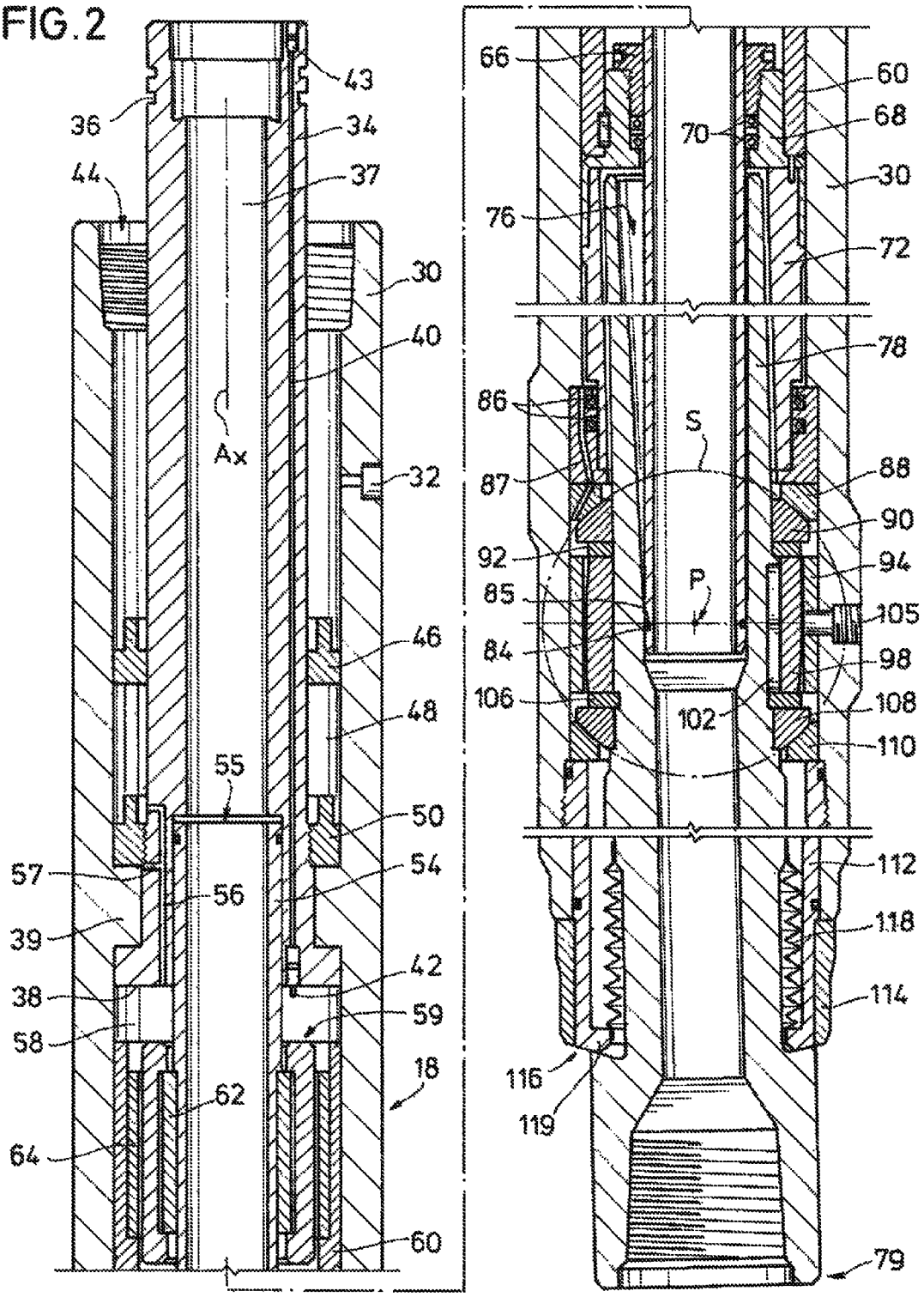
FIG. 2 is a side sectional view of an example of steering unit assembly for use with the earth boring assembly of FIGS. 1A-1C.

FIG. 2 shows in a side sectional view one example of the SUA 18 and which includes a collar 30 on its outer surface. Collar 30 as shown in the illustrated example is on elongate annular member, provides a protective outer layer tor components of the SUA 18, and whose structure as well as a means for coupling and structurally securing these components. A port 32 is shown formed radially through the housing of collar 30. As will be described in more detail below, collar 30 is a generally annular member, which is elongate, and includes selective profiles on its inner surface for the coupling of the components within SUA 18. An annular and elongate housing 34 is shown inserted within the annular space of collar 30 and having an end that projects axially out from an upstream end of collar 30. Grooves 56 circumscribe an outer surface of housing 34 at its upstream end, i.e. the end closer to the opening of wellbore 12 (FIGS. 1A-1C) when the SUA 18 is inserted in the wellbore 12. In an example grooves 36 provide coupling to drill string 16 (FIGS. 1A through 1C); and the annular space 37 inside of housing 34 may selectively receive drilling fluid (not shown) therein which is circulated within drill string 16.

A flange-like ledge 38 is depicted formed on a downstream end of housing 34 that is disposed within collar 30, Ledge 38 projects radially outward a distance from the lower terminal end of housing 34. A projection 39 is illustrated adjacent a lower end of ledge 38. Projection 39 is formed where an inner diameter of collar 30 reduces along a portion of its axial length. An upstream radial surface of ledge 38 abuts a downward-facing radial surface of a projection 39, so that projection 39 provides an axial stop thereby preventing relative upward movement of housing 34 with respect to collar 30. Axially formed through a sidewall of housing 34 is a passage 40, which extends the length of housing 34. Sealed feed through connectors 42, 43 are provided respectively at the downstream and upstream ends of passage 40. As will be described in more detail below, passage 40 allows for the wired communication between connector 42 and 43. Connector 42 prevents ingress of dielectric fluid contained in collar 30.

Still referring to FIG. 2, as shown the outer diameter of housing 34 is spaced radially inward from an inner diameter of the inner surface of collar 30, an annulus 44 is formed between these members that extends along a portion of the axis of the housing 34. A ring-like piston 46 is shown inserted within annulus 44 and which is axially moveable within annulus 44. An annular chamber 48 is defined in the annulus 44 on a side of piston 46 distal from grooves 36. An annular nut 50 is shown in chamber 48 and landed on an upstream radial surface of projection 39. Nut 50 of FIG. 2 is coupled to an outer surface of housing 34.

An annular flow tube 54 is shown disposed within collar 30 and having an upstream end 55 (FIG. 3) that inserts into a lower portion of the annular space 37 that extends through housing 34. A diameter of the annular space 37 projects radially outward proximate ledge 38 to accommodate insertion of the upstream end 55. A passage 56 is shown extending axially through the sidewall of housing 34 adjacent upstream end 55. An upstream end of passage 56 projects radially outward and into fluid communication with chamber 48. Optionally, a port 57 projects radially outward from passage 56 through housing 34 to its outer surface. A downstream end of passage 56 opens into a chamber 58 that is in an annular space between flow tube 55 and an inner surface of collar 30. Accordingly, piston 46 in combination with chambers 48, 58 and passage 56 provide a. pressure compensation means for pressurizing the space within chamber 58 to that of ambient. In the illustrated embodiment, piston 46 will move within annulus 44 in response to changing ambient pressures. More specifically, when ambient pressures exceed pressure in chamber 58, piston 46 is urged downward thereby pressurizing fluid in chambers 48, 58 and passage 56, until pressure in chambers 48, 58 and passage 56 is substantially equal to ambient pressure. Similarly, when ambient pressure is less than that in chambers 48, 58 and passage 56, piston 46 is urged upward in annulus 44 to relieve pressure in chambers 48, 58 and passage 56 until equal to ambient. In one example, port 57 communicates fluid between passage 56 and inside of nut 50 thereby equalizing pressure on a lower end of nut 50 to that within chamber 48.

Included within chamber 58 is a motor assembly 59 which includes a ring-like rotor 60 set on an outer radial portion of chamber 58 and extending along an axial portion of chamber 58. Set radially within rotor 60 is a stator 62, which also is a ring-like member and within chamber 58. A magnet rotor 64, which in the example shown is an elongate ring-like array of permanent magnets, is disposed between rotor 60 and stator 62 and coupled to the inner radial surface of rotor 60. In an example of operation, the motor assembly 59 operates when a control signal is supplied from a control unit, such as within controller 28 (FIG. 1A/B), through the connectors 42,43 to the stator 62. In this example, the control signal energizes a set of coils (not shown) integral to the stator 62, which then imparts a rotational motive force on the magnet rotor 64. The resulting rotational movement of the magnet rotor 64 in turn results in rotational movement of the rotor 60 and an orientation sleeve 72. Below motor assembly 59 is a ring-like retaining nut 66 which axially threads to an inner surface of a collar-like flow tube positioner 68, and which provides an axial stop for flow tube 54. As shown in FIG. 2, bearings 70 are provided between flow tube 54 and flow tube positioner 68. In the illustrated example, bearings 70 are shown as roller-type bearings and provide relative rotation between flow tube positioner 68 and flow tube 54. However, other types of bearings can be used in this application, including journal bearings, as well as a thin film of lubricant. Optionally included with SUA 18, and disposable downhole, is a turbine and controller (not shown), wherein turbine is rotatable in response to drilling fluid flowing down drill string 16 and selectively generates electrical power for operating motor assembly 59.

Still referring to FIG. 2, an orientation sleeve 72 is shown mounted to a downstream end of flow tube positioner 68. Orientation sleeve 72 is a generally annular member that has a substantially cylindrical outer surface and projects axially away from motor assembly 59 and within collar 30. Rotor 60 is coupled to flow tube positioner 68, thus energizing motor assembly 59 causes rotation of rotor 60, that in turn produces selective rotation of flow tube positioner 68 and orientation sleeve 72.

Figure 4:
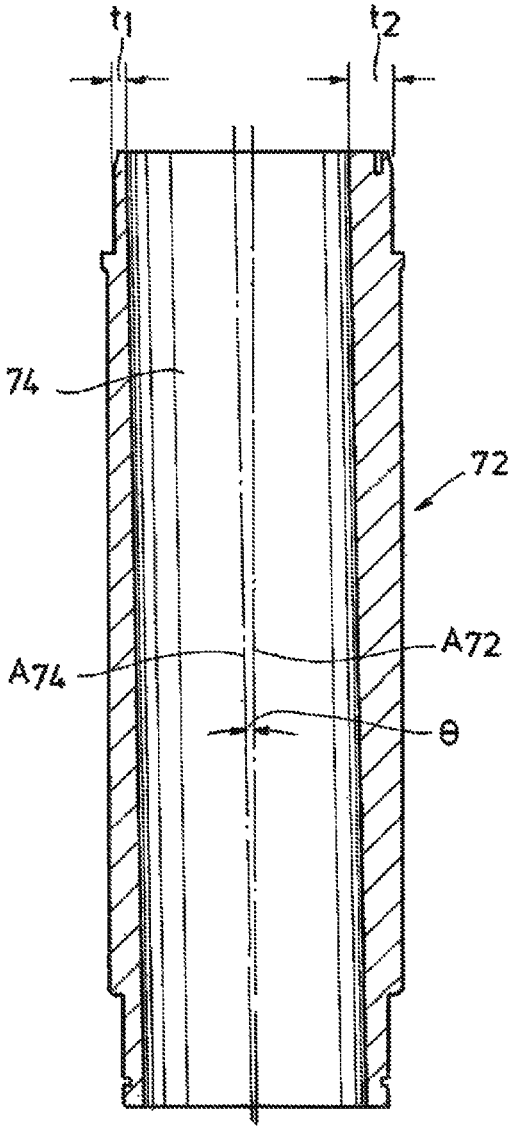
FIG. 4 is a side sectional perspective view of an example of an orientation sleeve collar for use with the steering unit assembly of FIG. 2.

Referring now to FIG. 4, orientation sleeve 72 is shown in a side perspective cm away view. In the illustrated, a bore 74 that extends axially through orientation sleeve 72. Bore 74 is not coaxially disposed within sleeve 72, but instead an axis $A_{74}$ of bore 74 is shown projecting along a path that is at an angle Θ which is oblique to an axis $A_{72}$ of orientation sleeve 72. In one example the positioning of bore 74 is offset within orientation sleeve 72, so that not only is axis $A_{74}$ oblique to axis $A_{72}$, axes $A_{72}$, $A_{74}$ are set radially apart from one another at opposing ends of orientation sleeve 72. To belter illustrate the radially set apart axes $A_{72}$, $A_{74}$, a sidewall thickness $t_1$ of sleeve 72 at one azimuthal location is less than a sidewall thickness $t_2$ at an angularly spaced apart location.

Figure 3:
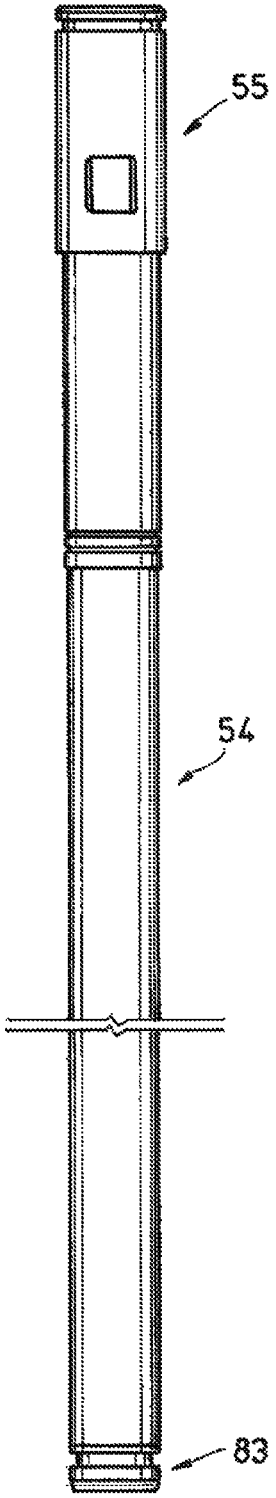
FIG. 3 is a side view of an example of a flow tube for use with the steering unit assembly of FIG. 2.
Figure 5:
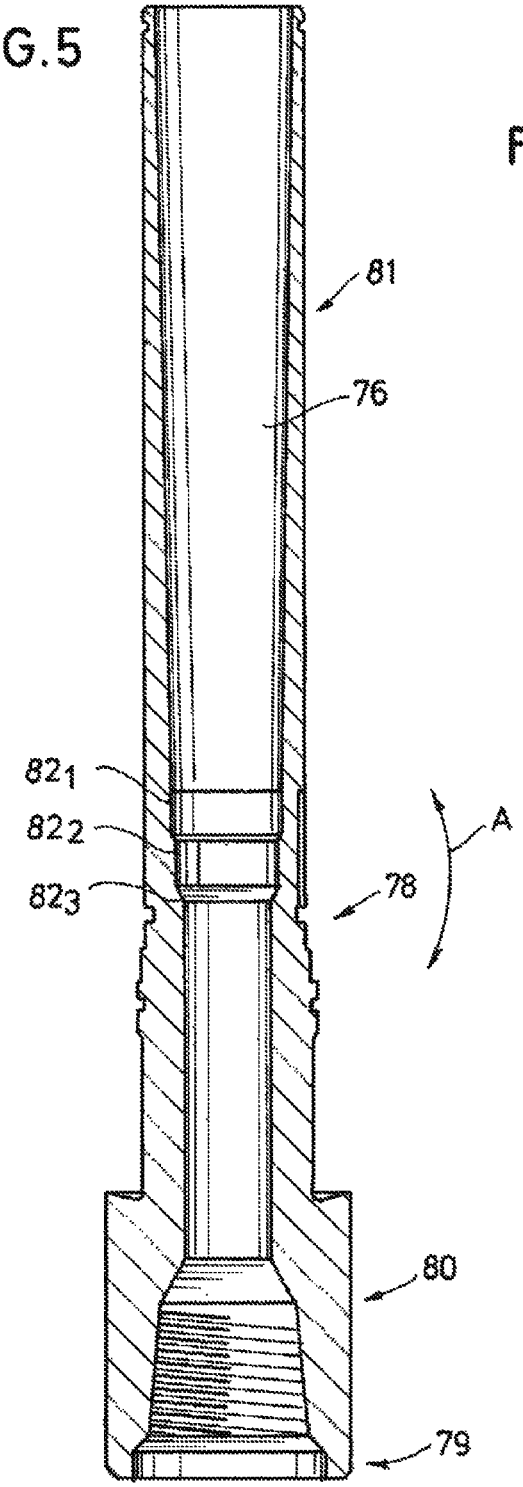
FIG. 5 is a side sectional perspective view of an example of a drive shaft for use with the steering unit assembly of FIG. 2.

Referring back to FIG. 2, a downstream end of flow tube 54 is shown inserted into a bore 76 that projects axially through a drive shaft 78. As will be described in more detail below, strategic axial positioning of the flow tube 54 can create a static seal on an end of the flow tube 54 and drive shaft 78. FIG. 5 shows in a side sectional view one example of drive shaft 78. In this example, the diameter of bore 76 increases proximate the downstream end of drive shaft 78 to define a receptacle 79, that as shown in FIG. 1 can receive drill bit 24 for excavating wellbore 12. A portion of the drive shaft 78 having the receptacle defines a base portion 80, wherein an outer diameter of base portion 80 projects radially outward above the upstream end of receptacle 79. A portion of drive shaft 78 distal from receptacle 79 defines a shroud portion 81; the diameter of bore 76 adjacent shroud portion 81 increases with proximity to its upstream end. As described below, drive shaft 78 is pivotable about its mid-portion, thus the strategic dimensioning of the diameter of bore 76 within shroud portion 81 allows a pivoting action around flow tube 54 so that the inner surface of bore 76 remains out of interfering contact with the outer surface of flow tube 54 as the drive shaft 78 is being pivoted. Further shown in FIG. 5 are a series of profiled sections $\mathbf{82}_1$-$\mathbf{82}_3$ in bore 76 that are formed where the diameter of bore 76 changes to form these profiles $\mathbf{82}_1$-$\mathbf{82}_3$. Profile $\mathbf{82}_2$ is strategically formed to be in contact with an O-ring 84 that is set in a recess 85 circumscribing a portion of flow tube 54 proximate its lower end 83 (FIG. 3). The O-ring 84 defines a static seal between the flow tube 54 and drive shaft 78. Thus when the drive shaft 78 pivots along the path represented by curved arrow A, a static seal is maintained between O-ring 84 and profile $\mathbf{82}_2$. It should be pointed out that the pivoting motion of drive shaft 78 relative to collar 30 is not limited to a motion in a single plane, but can include swiveling where the relative movement between drive shaft 78 and collar 30 occurs across more than one plane. For example, swiveling motion can resemble a precession type motion. An advantage of the static seal along O-ring 84 is that the need for a seal that rotates or is otherwise dynamic is eliminated, as the static interface between the tower end 83 and profile $\mathbf{82}_2$ defines a flow barrier that blocks fluid flow passage from within flow tube 54 and bore 76 to outside of drive shaft 78. Accordingly, any fluid flowing within flow tube 54 from drill string 16 (FIGS. 1A through 1C) will not make its way between flow tube 54 and the inner surface of bore 76, but instead will continue within bore 76 downstream of profile $\mathbf{82}_3$ and towards receptacle 79.

Referring back to FIG. 2, a bearing assembly 86 is shown provided on an inner surface of collar 30, radially adjacent an outer surface of orientation sleeve 72, and axially proximate the lower end of orientation sleeve 72. Bearing assembly 86 reduces rotational friction as orientation sleeve 72 rotates within collar 30. Bearing assembly 86 is shown as a roller-type bearing assembly, but can instead be a journal type, as well as a thin floating film-type. A ring-like bearing shoulder ring 87 is shown just below bearing assembly 86 and generally coaxial with bearing assembly 86. Thus the outer surface of bearing shoulder ring 87 is in close contact with an inner surface of collar 30, and wherein ring 87 provides axial support for bearing assembly 86. Ring 87 has a wedge-like cross-section whose thickness increases with distance away from bearing assembly 86. The respective lower ends of ring 87 and orientation sleeve 72 are positioned at roughly the same axial location within collar 30. A ring-like spherical bearing outer race 88, which is also in the annular space between collar 30 and drive shaft 78, is set on a lower end of ring 87. Outer race 88 is in selective rotating contact with a spherical bearing inner race 90 shown mounted on an outer circumference of drive shaft 78. The contact surfaces between races 88, 90 run along a path that is oblique to an axis $A_X$ of collar 30 and project radially outward with distance away from a lower end of orientation sleeve 72.

Figure 6:
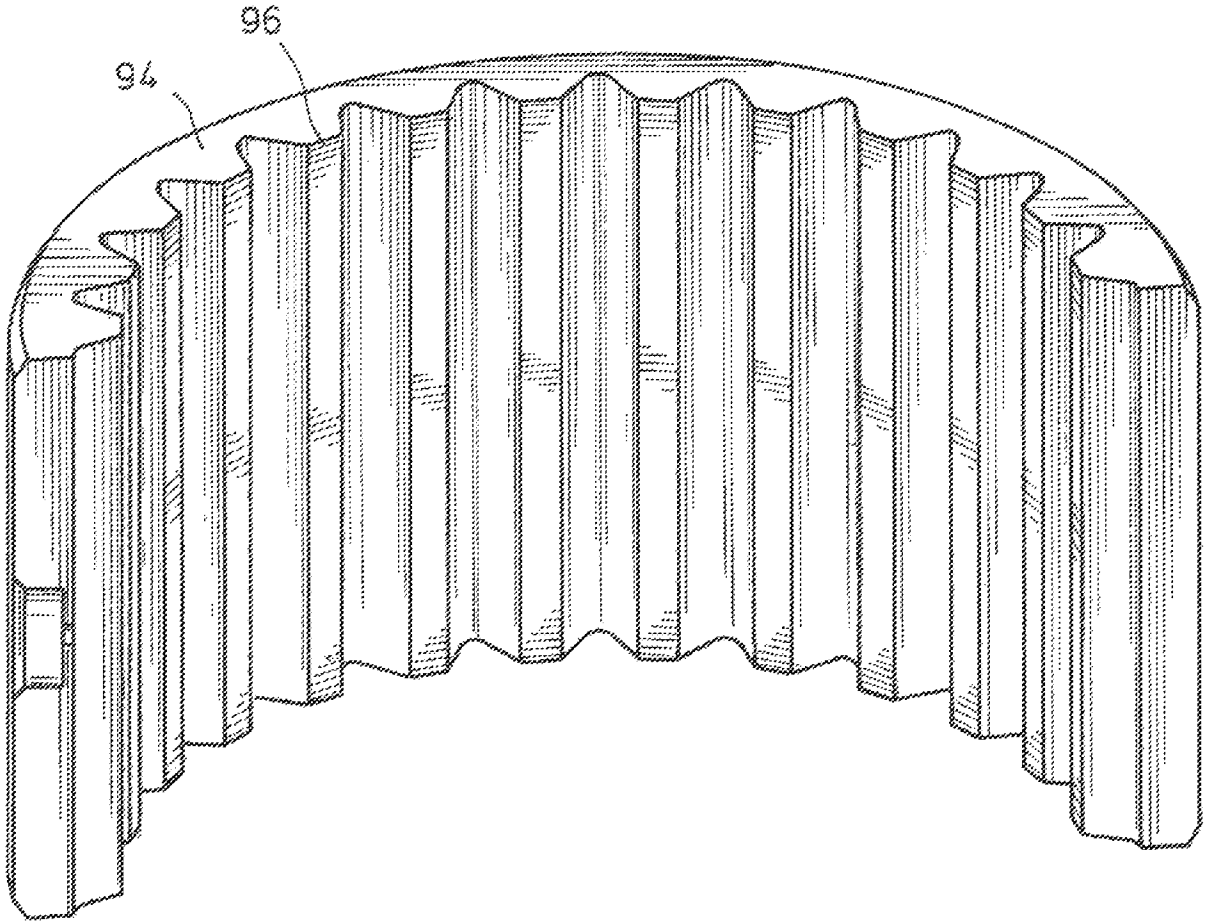
FIG. 6 is a perspective view of an example of a female spline for use with the steering unit assembly of FIG. 2.
Figure 7:
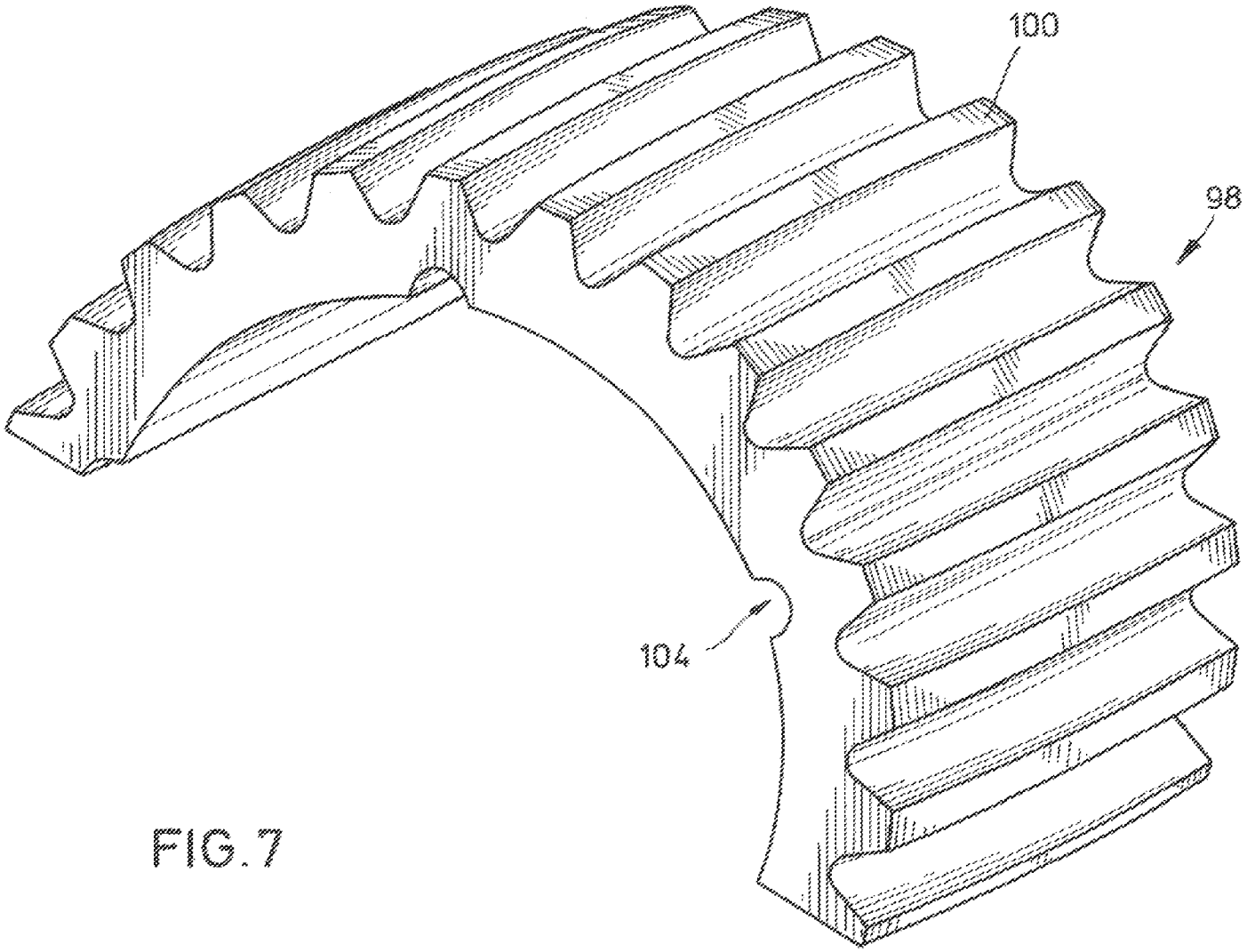
FIG. 7 is a perspective view of an example of a male spline for use with the steering unit assembly of FIG. 2.

A ring-like load spacer bearing 92 is shown on a lower end of race 90. Set axially downward from load spacer bearing 92 is a ring-like female spline 94 that couples to an inner surface of collar 30. Shown in perspective view in FIG. 6 is one example of the female spline 94, and which can be made up of multiple sections that are mounted within collar 30. Spline members 96 or elements project from, and axially across, a radially inward feeing surface of the female spline 94. Spline members 96 are generally raised members at spaced apart locations that resemble gear teeth. Referring back to FIG. 2, a male spline 98 is shown that is in selective engagement with female spline 94. Male spline 98 is also a ring like member, and as shown in FIG. 7 includes corresponding spline members 100 that project radially outward, and extend axially along its outer radial surface. Spline members 100 selectively mesh into recesses between adjacent spline members 96 of female spline 94 (FIG. 6). Optionally, spline members 100 are involute having widths greater at their mid portions than at their ends. Rotation of one of the female or male splines 94, 98 necessarily causes rotation of the other spline 94, 98 and in the same rotational direction. In this fashion, rotation of the collar 30 via the drill string 26 (FIGS. 1A through 1C) causes corresponding rotation of the drive shaft 78. In the cutaway view of FIG. 2, a dowel 102, which is a pin-like member, extends axially within an opening 104 (FIG. 7) shown formed along an inner surface of the male spline 98. As dowel 102 is coupled with the outer surface of drive shaft 78, the presence of dowel 102 thus rotationally attaches drive shall 78 and male spline 98. Therefore any rotation of male spline 98 correspondingly induces rotation of drive shaft 78. One or more threaded fasteners 105 may be used to attach female spline 94 to collar 30 so that when collar 30 is rotated, female spline 94 also rotates and in the same direction. Another dowel (not shown), similar to dowel 102, retains female spline 94 to collar 30.

A thrust ring 106 is shown set in a lower end of male spline 98 and which circumscribes drive shaft 78. Just below ring. 106 are inner and outer races 108, 110 which contact one another along an oblique interface and which are similar in construction with races 88, 90. Thus, the combination of races 88, 90, 108, 110 allow (or relative pivoting of drive shaft 78 to collar 30. Additionally, in an example, the interface between races 88, 90 and races 108, 110 are along an outer surface of a sphere S, wherein sphere S is bisected by a plane P in which O-ring 84 is disposed. A retention ring 112 coaxially threads to an inner surface of a lower end of the collar 30. While a portion of retention ring 112 is circumscribed by the collar 30, a lower portion projects axially downward from the lower terminal end of collar 30. Axially set lower from races 108, 110 is a seal sleeve 114 that provides a lower seal between collar 30 and drive shaft 78. Seal sleeve 114 circumscribes the portion of the retention ring 112 that extends past the lower end of collar 30. Circumscribed by retention ring 112 is an annular bellows assembly 116, which is made up of a bellows 118. In the illustrated example bellows 118, is a thin-walled member with walls that are undulating along its length to thereby allow for axial movement as well as pivoting and yet can still maintain a seal between the drive shaft 78 and collar 30. Also included with the bellows assembly 116 is a bellows nut 119 that couples to a lower end of bellows 118.

Figure 8:
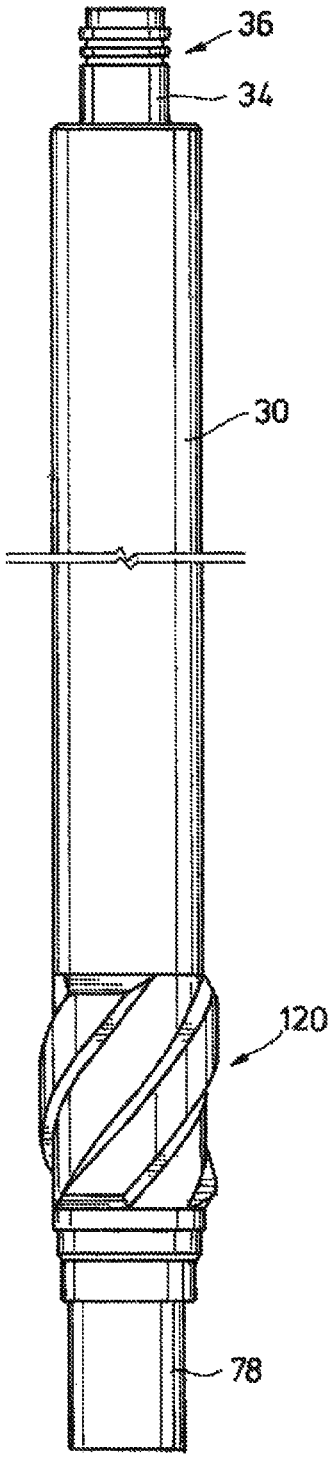
FIG. 8 is a side view of an example of a steering collar for use with the steering unit assembly of FIG. 2.

FIG. 8 shows in a side view one example of collar 30 and wherein drive shaft 78 projects axially from one end and wherein housing 34 extends axially outward from an opposite end. In this example, a stabilizer 120 is shown on the outer surface of collar 30 which is made up of some raised portions that are spaced circumferentially apart and wherein each portion follows a generally, helical pattern along the outer surface of collar 30. The presence of stabilizer 120 can provide a spacing between the collar 30 and inner surface of wellbore to thereby provide protective separation between the two.

In one example of operation, as shown in FIGS. 1A-1C and FIG. 2, drill string 16 has an upstream end depending from drilling rig 122. A top drive or rotary table 124 provides a rotational force onto the drill string 16 that in turn rotates SUA 18. Rotating SUA 18 provides a rotating force onto the outer surface of collar 30 that via splines 94, 98 and drive shaft 78 causes rotation of drill bit 24, that in one embodiment mounts into receptacle. To form the bend 26 of FIG. 1C, motor assembly 59 is selectively activated to cause rotation of rotor 60 that as described above rotates orientation sleeve 72. The obliqueness of bore 74 then causes a precession-type movement of drive shaft 78 to move drive shaft in the precession-like motion with respect to drill string 16 and collar 30. Rotating the orientation sleeve 72 at a designated rotational velocity, can keep the drive shaft 78 in a constant azimuthal orientation with respect to a vertical axis, even though the drill string 16 and collar 30 continues to rotate. Knowing a designated azimuthal position, the bend 26, and thus deviated wellbore 27, can be formed as described above. An advantage of the crown in the splines allows continued rotational motion transfer between collar 30 and drive shaft 78 even though drive shaft 78 can pivot, thereby causing the respective spline members 96, 100 to move axially with respect to one another. In an example of operation, to obliquely orient the drive shaft 78 (and bit 24) with respect to collar 30, orientation sleeve 72 is rotated in a circular direction opposite the rotational direction of drill string 16, but at the same angular rotational rate as drill string 16. Changing direction, or directing the drill bit 24 along a straight non-deviating path, can be accomplished by rotating the orientation sleeve 72 in a direction opposite the drill string 16, but at a rate of rotation that Is different from that of the drill string 16.

Figure 9A:
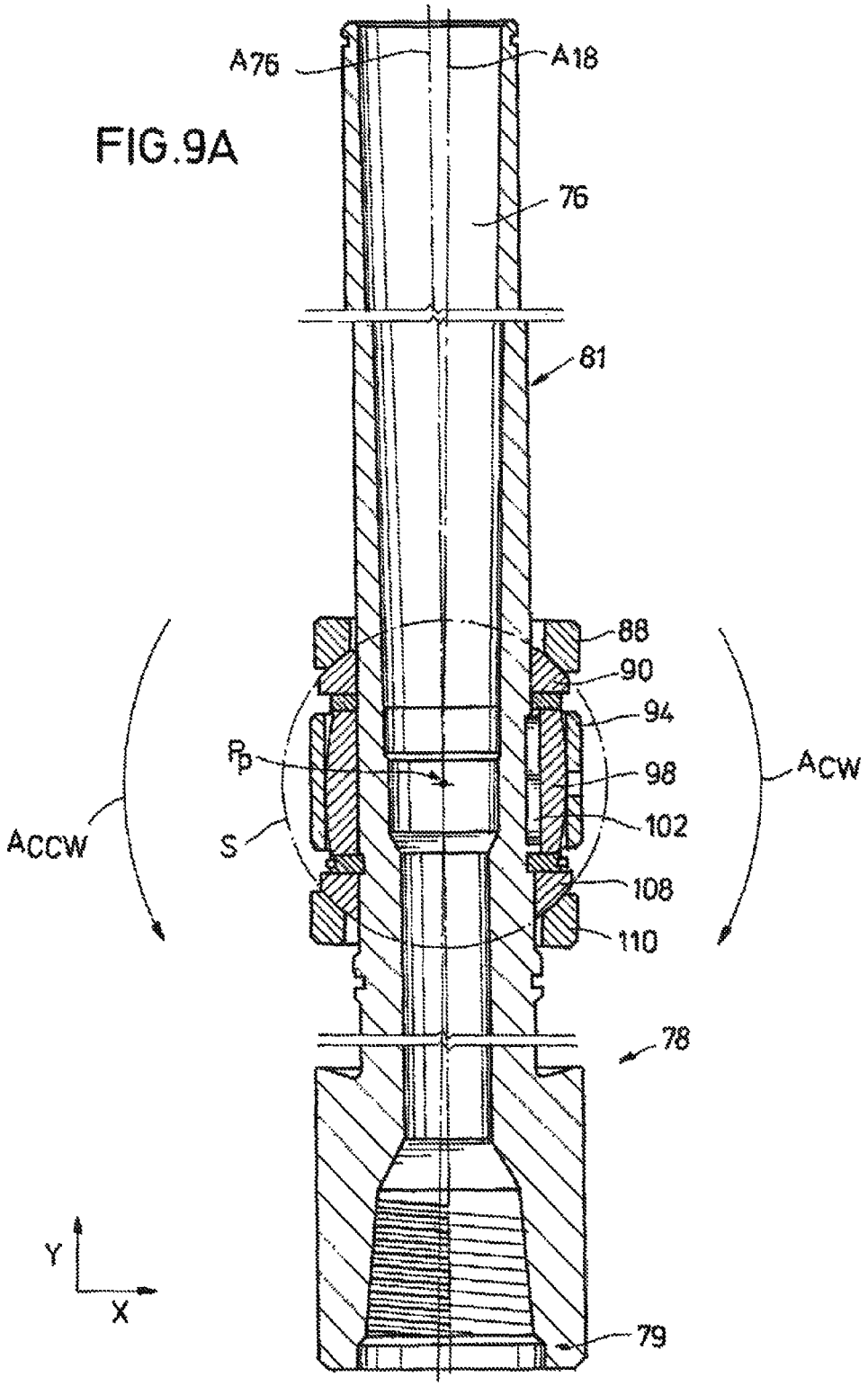
FIGS. 9A and 9B are side sectional views of examples of a drive shaft for use with the steering unit assembly of FIG. 2 respectively pivoted into different orientations.
Figure 9B:
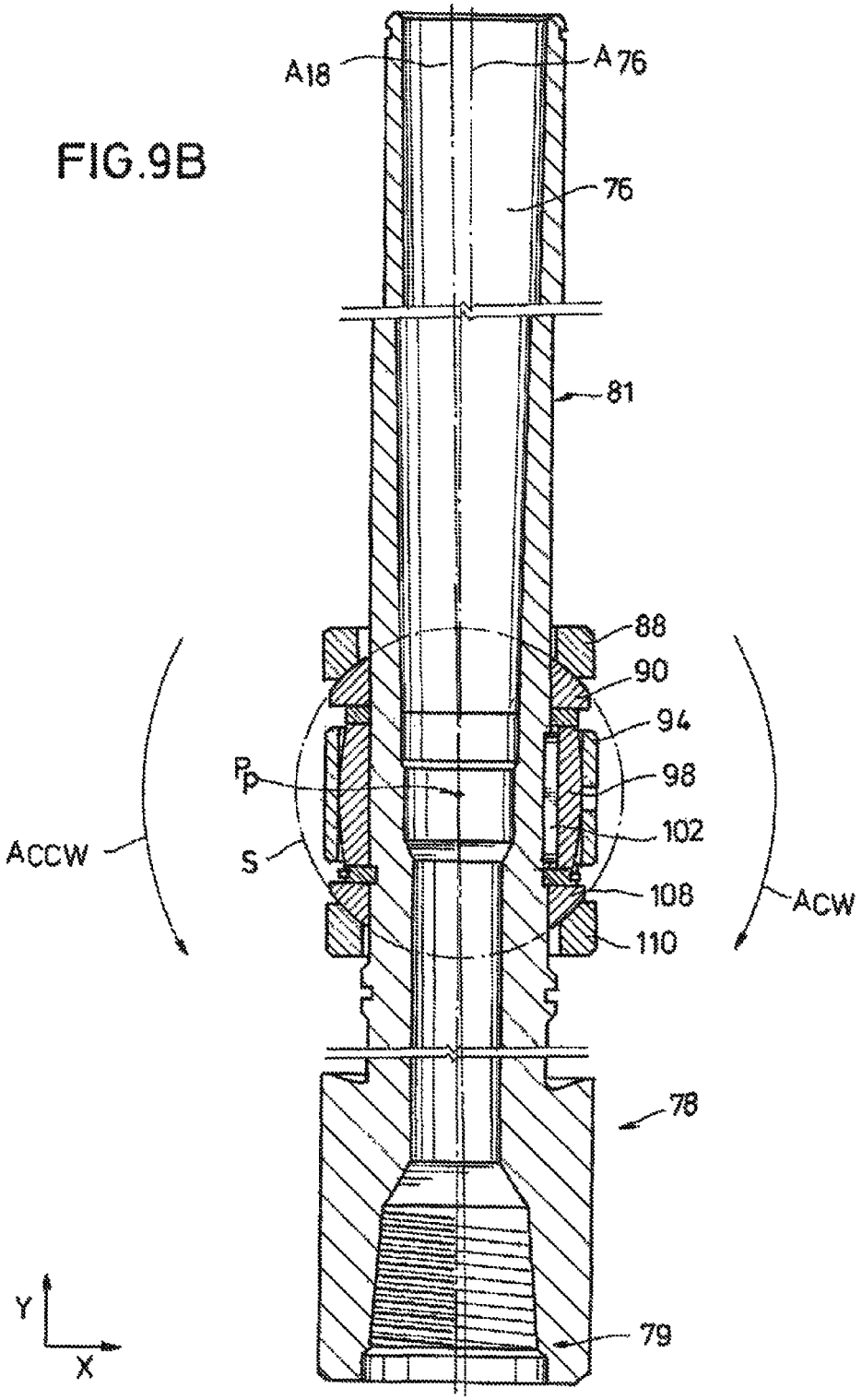

Shown in side sectional views in FIGS. 9A and 9B are examples of the drive shaft 78 pivoting between different orientations. Pivoting drive shaft 78 in a clockwise direction, as illustrated by arrow $A_{CW}$, changes the orientation of the drive shaft 78 of FIG. 9A to that of FIG. 9B. Similarly, pivoting drive shaft 78 in a counter-clockwise direction, as illustrated by arrow $A_{CCW}$, changes the orientation of the drive shaft 78 of FIG. 9B to that of FIG. 9A. In each of FIGS. 9A and 9B, axis $A_{76}$ of bore 76 is oblique with axis $A_{18}$ of steering unit assembly 18 (FIG. 2). In the examples of FIGS. 9A and 9B, axes $A_{76}$, $A_{18}$ are radially offset from one another at the opening of the shroud 81, and proximate the receptacle 79. However, the radial order of axes $A_{76}$, $A_{18}$ changes between the pivoted orientations illustrated in FIGS. 9A and 9B. For example, axis $A_{18}$ is closer than axis $A_{76}$ to the Y-axis of the Cartesian coordinates of FIG. 9A proximate the opening of bore 76; but axis $A_{18}$ is spaced farther away from the Y-axis than axis $A_{76}$ proximate the opening of bore 76. Depicted in FIGS. 9A and 9B the axes $A_{76}$, $A_{18}$ intersect one another at pivot point P; thereby indicating a point or axis about which drive shaft 78 rotates while being pivoted. Pivot point $P_P$ is at the center of sphere S (and in plane P); as described above the outer surface of sphere S is coincident with interfaces between races 88, 110 and races 90, 108.

Figure 10A:
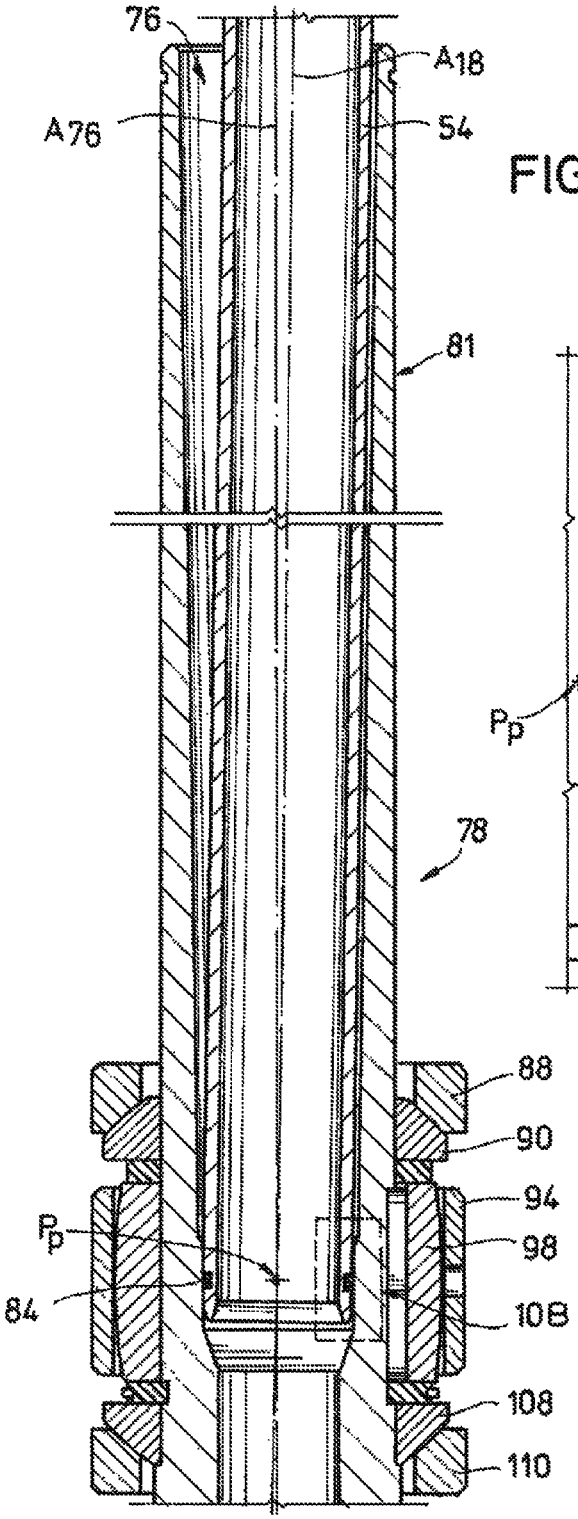
FIGS. 10A and 11A are side sectional views of the drive shaft of FIGS. 9A and 9B respectively with an example of an associated flow tube.

FIG. 10A is a side sectional view of an example of the drive shaft 78 having substantially the same orientation as that of FIG. 9A and so that axis $A_{76}$ of bore 76 is lower on the Y-axis than axis $A_{18}$ of the steering unit assembly 18 (FIG. 2). Also shown in FIG. 10A is flow tube 54 inserted into bore 76 and in sealing contact with an inner surface of bore 76. In this example, flow tube 54 remains substantially aligned with axis $A_{18}$, and thus drive shaft 78 is pivotable with respect to flow tube 54. As indicated above, the diameter of bore 76 increases with distance from end 83 so that the sidewalls of the bore 76 remain clear of the flow tube 54 as the drive shaft 78 pivots in response to rotation of sleeve 72 (FIG. 2). Thus the presence of flow tube 54 inside bore 76 does not interfere with drive shaft 78 pivoting.

Figure 10B:
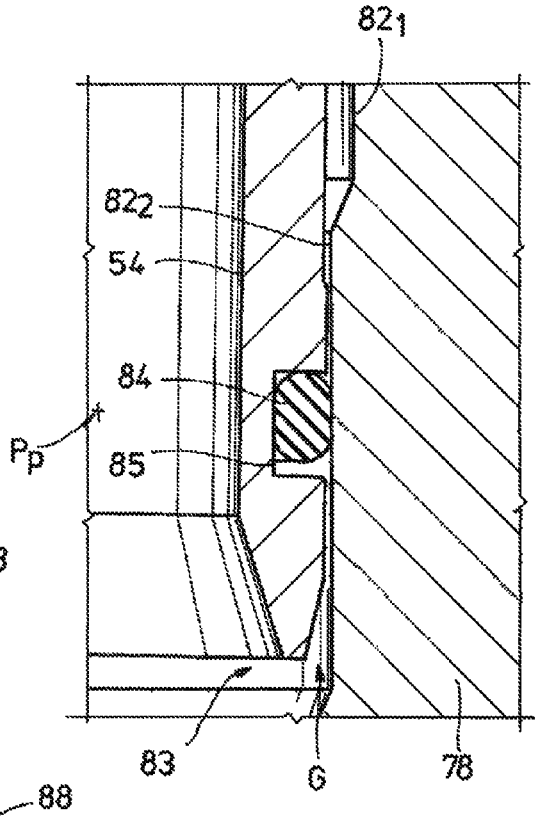
FIGS. 10B and 11B are side sectional and enlarged views of portions of FIGS. 10A and 11A respectively, and where an O-ring is disposed between the flow tube and drive shaft.
Figure 11A:
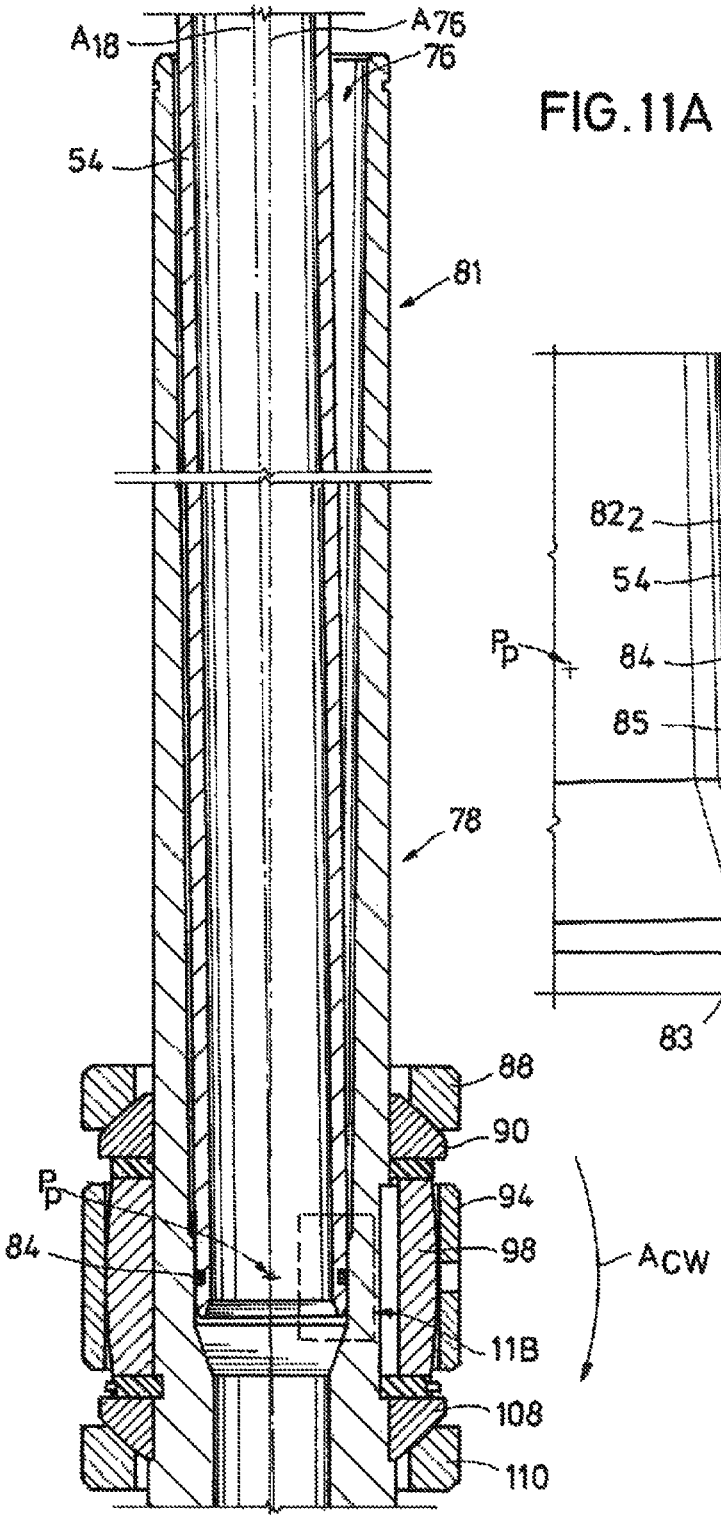
Figure 11B:
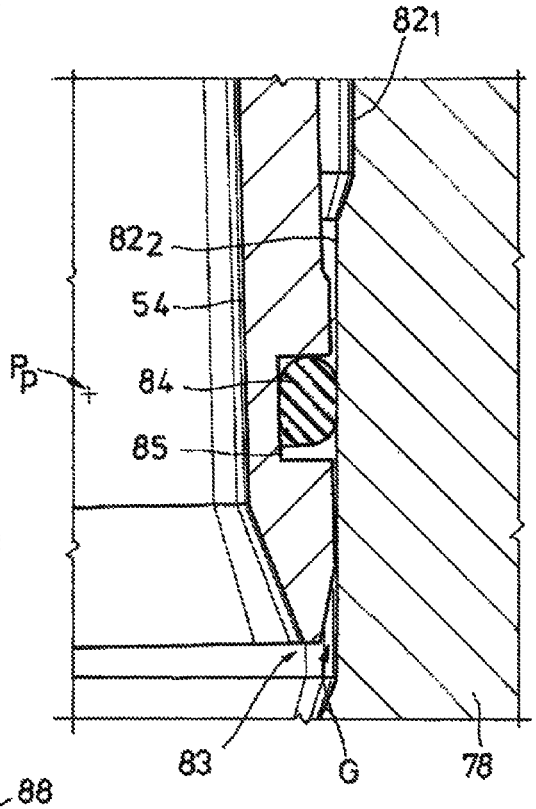

FIG. 10B illustrates in side sectional and enlarged view a portion of an example of flow tube 54 proximate its end 83 and inserted into drive shaft 78. As depicted in the example of FIG. 10B, while the outer surface of flow tube 54 remains clear of drive shaft 78, O-ring 84 is shown in sealing contact with flow tube 54 inside of recess 85, extending across a gap G between flow tube 54 and drive shaft 78, and into sealing contact with the profile $\mathbf{82}_2$ formed along bore 76 in drive shaft 78. As shown, the outer surface of flow tube 54 upstream of O-ring 84 is closer to the sidewalls of bore 76 than that downstream of O-ring 84. In the illustrated embodiment, because O-ring 84 (and recess 85) is strategically located proximate end 83, the sealing interface formed by O-ring 84 between flow tube 54 and drive shaft 78 operates as a "static seat." In an example a static seal provides a flow and a pressure barrier between surfaces that have little to no movement relative to one another. As illustrated in the example of FIGS. 11A and 11B, drive shaft 78 has swiveled, so that when viewed in cross section, the drive shaft 78 appears to have pivoted in a clockwise direction so that, the relative vertical location of axes $A_{18}$, $A_{76}$ has changed over that of FIGS. 10A and 10B, thereby bringing the surface of flow tube 54 that is downstream of O-ring 84 closer to the inner surface of bore 76 than the surface of flow tube 54 upstream of O-ring 84. Referring now to FIGS. 10B and 11B, in the illustrated example of operation, FIG. 10B depicts the drive shaft 78 in is farthest counter-clockwise pivot, and in FIG. 11B, the drive shaft 78 is shown in its farthest clockwise pivot; thus comparing FIGS. 10B and 11B the drive shaft 78 is shown in orientations describing its full range of pivoting motion. Further illustrated is how there is little to no axial movement between O-ring 84 and recess 85 or between O-ring 84 and profile $\mathbf{82}_2$. Further an annular gap G is shown between the outer surface of flow tube 54 and profile $\mathbf{82}_2$, where the thickness of gap G on opposite sides of recess 85 changes between the counter-clockwise and clockwise pivot positions of the drive shaft 78 illustrated in FIGS. 10B and 11B. Example thicknesses of gap G range from about 0.005 inches to about 0.015 inches.

Figure 12:
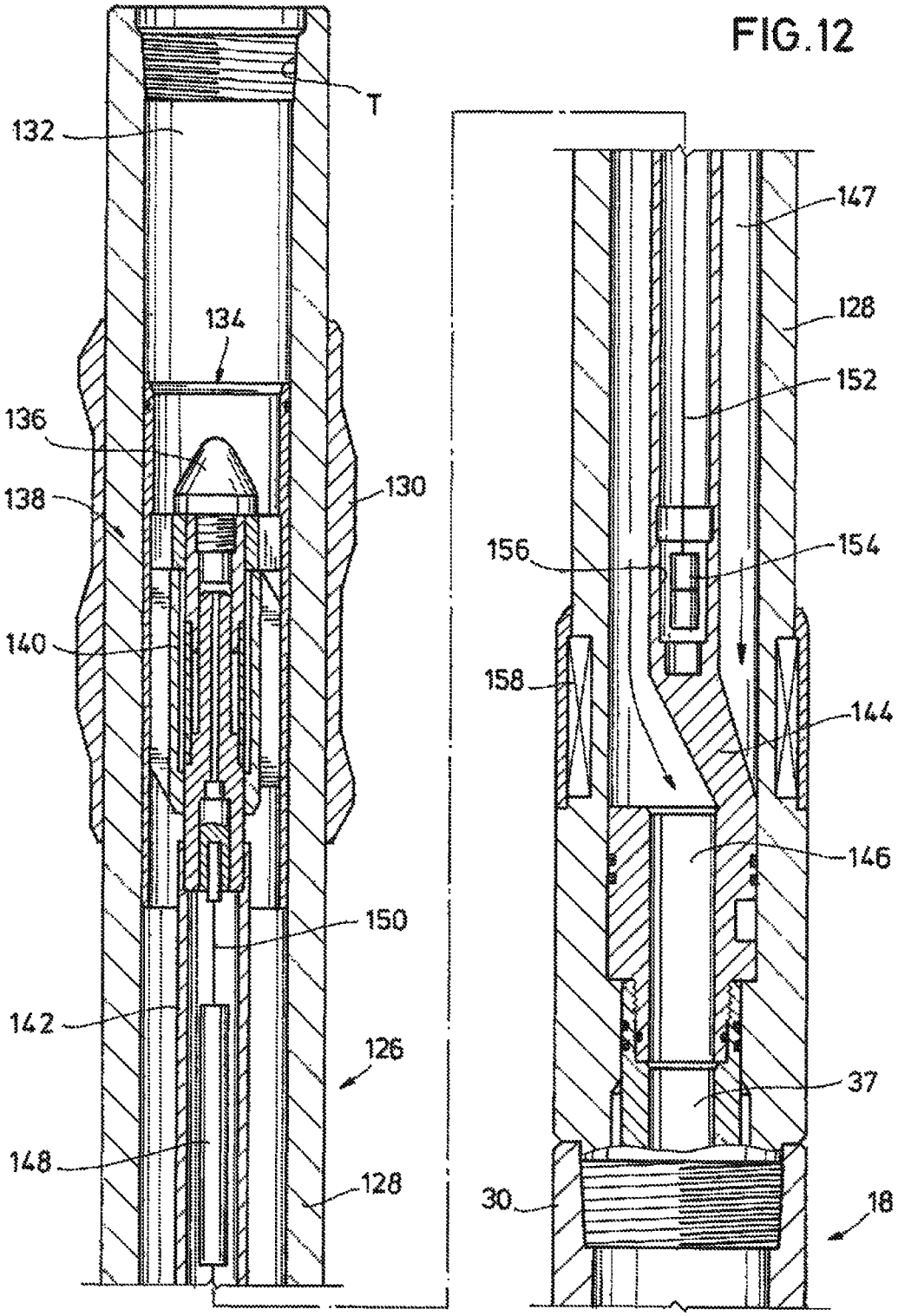
FIG. 12 is a side sectional view of an example of a control unit assembly that selectively mounts to an upstream end of the steering unit assembly of FIG. 2.

Illustrated in side sectional view in FIG. 12 is an example of a control unit assembly 126 that can optionally be included with the steering unit assembly 18. Control unit assembly 126 includes an annular control collar 128 that has an end shown coupled with an end of collar 30 of steering unit assembly 18. In the illustrated example, collar 128 provides an outer covering for components within the control unit assembly 126. Further, threads T are provided on an end of collar 128 distal from where it is coupled with collar 30. In an embodiment, an end of drill string 16 distal from drilling rig 122 (FIG. 1) couples with threads T. As such, in the example of FIG. 12, rotational energy from drill string 16 rotates control collar 128, which in turn rotates collar 30. As discussed above, rotating collar 30 ultimately produces rotation of drill bit 24 (FIGS. 1A-1C). An optional stabilizer 130 is shown mounted on an outer surface control collar 128 for use in stabilizing assembly 126 during drilling operations. A bore 132 is formed within control collar 128 and in which a generator assembly 134 is disposed. In the example of FIG. 12, electricity is generated by generator assembly 134, which is used to power components within and associated with drilling assembly 10 (FIG. 1). An upstream end of generator assembly 134 is equipped with a frusto-conically shaped bullnose 136 for diverting fluid (such as drilling mud) flowing through bore 132 towards blades of an impeller assembly 138 disposed downstream of bullnose 136. In one example of operation, directing fluid flow past the impeller assembly 138, rotates impellers and an associated shaft in the assembly 138, that in turn rotates a rotor 140 disposed in a magnetic field thereby generating electricity. An elongate annular pressure housing 142 is shown downstream of generator assembly 134; and having an end distal from generator assembly 134 that terminates at an upstream end of a flow diverter 144. A bore 146 is shown formed axially through a downstream portion of flow diverter 144. Bore 146 is in communication with an upstream end of annular space 37, so that fluid flowing in annulus 147 between collar 128 and pressure housing 142 is directed through bore 146 and into annular space 37.

Electricity generated within generator assembly 138 is directed to power and control electronics 148 via line 150. In an example, electricity from generator assembly 138 is conditioned by power and control electronics 148 so that the electricity is usable by components within the drilling assembly 10 (FIG. 1). In an embodiment, conditioning of the generated electricity includes rectifying the current, and/or adjusting values of voltage/current to match operational specifications of the user components. Line 152 transmits the conditioned electricity from power and control electronics 148 to an electrical connector 154, that in an example is rotatable. Power and control electronics 148 and lines 150, 152 axe disposed within pressure housing 142, whereas connector 154 is housed in cavity 156 formed in an upstream portion of flow diverter 144. An optional antenna 158 is shown formed on an outer surface of collar 128, wherein antenna 158 can be used for communicating signals uphole or to surface, where the signals can include data from sensors disposed downhole, or control commands for directing operation of the drilling assembly 10.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A steerable earth boring assembly comprising:

an annular collar that has an end in selective engagement with a drill string;

an annular flow tube having a portion disposed in the collar that is in fluid communication with an annulus in the drill string;

a drive shaft coupled with the collar and that is pivotable with respect to the flow tube;

a bore axially formed through the drive shaft that selectively receives an earth boring bit and that is in fluid communication with the flow tube; a passage intersecting the drill string, annular flow tube, and the drive shaft, so that when fluid is introduced into the drill string, the fluid flows into the annular flow tube and drive shaft; and a sealing element that defines a static seal between the flow tube and drive shaft.

2. The steerable earth boring assembly of claim 1, wherein the bore has a diameter that increases with distance away from the profile to define a shroud portion, and wherein the flow tube inserts into the shroud portion, so that when the drive shaft pivots an inner diameter of the bore within the shroud portion is spaced away from an outer surface of the flow tube.

3. The steerable earth boring assembly of claim 1, wherein the sealing element continues to block a flow of fluid when the drive shaft pivots with respect to the collar.

4. The steerable earth boring assembly of claim 1, wherein the sealing element comprises an elastomeric O-ring that circumscribes the flow tube.

5. The steerable earth boring assembly of claim 1, further comprising a splined coupling for transferring a rotational force between the collar and the drive shaft, so that when a rotating drill string applies a rotational force to the collar, the rotational force is transferred to the drive shaft and the drill bit through the splined coupling.

6. The steerable earth boring assembly of claim 1, further comprising an orientation sleeve having a generally cylindrical outer surface and that is coaxially disposed in the collar, a bore in the orientation sleeve that extends along a path that is oblique to an axis of the orientation sleeve, and wherein an end of the drive shaft distal from the drill bit inserts into the bore in the orientation sleeve, so that when the orientation sleeve is rotated, the drill bit shaft and the drill bit swivel with respect to the collar.

7. The steerable earth boring assembly of claim 1, wherein the flow tube is rotationally coupled with the drive shaft.

8. The steerable earth boring assembly of claim 1, wherein the drive shaft precesses about a plane in which the sealing element is substantially disposed.

9. A steerable earth boring assembly comprising:

a drive shaft that selectively couples to a drill string and that is selectively changed into an orientation that is oblique to the drill string;

an axial bore in tire drive shaft with an end that selectively receives a drill bit;

an annular flow tube that is rotationally coupled with the drive shaft and that comprises an end in fluid communication with an annulus in the drill siring, and a distal end in fluid communication with the bore in the drive shaft, so that when drilling fluid is provided into the annulus in the drill string, the drilling fluid flows within the drill string to the drill bit via the bore and the flow tube; and a seal between an outer surface of the flow tube and an inner surface of the bore in the drive shaft.

10. The steerable earth boring assembly of claim 9, wherein a diameter of the bore increases at a location distal from the drill bit to define a shroud portion, and wherein a portion of the flow tube is circumscribed by the shroud portion.

11. The steerable earth boring assembly of claim 9, wherein drive shaft swivels with respect to the flow tube.

12. The steerable earth boring assembly of claim 11, wherein the drive shaft swivels about a plane in which the seal is disposed.

13. The steerable earth boring assembly of claim 9, wherein the seal is rotationally coupled to the flow tube and to the drive shaft to define a static seal.

14. A steerable earth boring assembly comprising:

an annular flow tube in fluid communication with an annulus in a drill string;

a drive shaft rotationally coupled with the flow tube and that is selectively swiveled with respect to the flow tube;

a bore axially formed through the drive shaft that selectively receives an earth boring bit and that is in fluid communication with a bore in the flow tube; and a sealing element that defines a static seal between the flow tube and drive shaft.

15. The steerable earth boring assembly of claim 14, wherein the sealing element comprises a resilient O-ring.

16. The steerable earth boring assembly of claim 14, wherein the sealing element is rotationally coupled to both the flow tube and to the drive shaft.

17. The steerable earth boring assembly of claim 14, wherein the drive shaft swivels about a plane in which the sealing element is disposed.

18. The steerable earth boring assembly of claim 14, further comprising a collar for coupling the drive shaft to the drill string.

19. The steerable earth boring assembly of claim 14, further comprising a means for swiveling the drive shaft, so that the drive shaft is moveable in a precession like motion.

* * * * *